US006234822B1

(12) United States Patent
Gallin et al.

(10) Patent No.: US 6,234,822 B1
(45) Date of Patent: May 22, 2001

(54) CONNECTOR ON A PRINTED CIRCUIT, COMPRISING A PLUG AND A BASE

(75) Inventors: Christophe Gallin; Michael Klein; Damien Sejourne, all of Le Mans (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/435,263

(22) Filed: Nov. 5, 1999

(30) Foreign Application Priority Data

Nov. 6, 1998 (FR) ..... 98 14028

(51) Int. Cl.[7] ..... H01R 13/62
(52) U.S. Cl. ..... 439/329; 439/260
(58) Field of Search ..... 439/260, 329, 439/67, 79, 607

(56) References Cited

U.S. PATENT DOCUMENTS 4,863,395 9/1989 Babuka et al. ..... 439/260

FOREIGN PATENT DOCUMENTS 0 036 933 10/1981 (EP) .
0 263 746 4/1988 (EP) .
0 405 333 A2 1/1991 (EP) .

*Primary Examiner*—Paula Bradley
*Assistant Examiner*—Sun McCamey
(74) *Attorney, Agent, or Firm*—Perman & Green, LLP

(57) ABSTRACT

Connector designed to come to be engaged on an edge (2) of a printed circuit board (1) and has contacts (3, 4) designed to take support elastically on either side of board (1) in order to establish a direct connection with the conductive connection areas of this board.

The connector comprises a base (6) and a plug (8) comprising means cooperating together during the insertion of plug (8) into base (6) in order to:

guide the introduction of plug (8) into base (6);

move plug (8) upward to permit a lining up of row of contacts (4) borne by the second part (10) of plug (8) onto the conductive areas situated under the edge of board (1) and simultaneously;

bend flexible part (9) of plug (8) downward to permit a lining up of row of contacts (3) borne by this flexible part (9) on the conductive areas situated on the edge of board (1).

8 Claims, 4 Drawing Sheets

CONNECTOR ON A PRINTED CIRCUIT, COMPRISING A PLUG AND A BASE

BACKGROUND OF THE INVENTION

The present invention concerns a connector designed to come to be engaged on the edge of a printed circuit board and having contacts designed to be supported elastically on either side of the board to establish a direct connection with the conductive connection areas of this board.

The invention concerns in particular a connector of an accessory to be connected directly to the printed circuit of a mobile telephone, this mobile telephone not possessing an input/output connector on its base, but rather a printed circuit (usually soldered to the input/output connector) directly accessible for its connection to an outside accessory or plug.

The closest prior art is EP 0 263,746.

The major technical problem posed with this type of application relates to the degradation, or even destruction of the contacts by the greatly abrasive edges of the printed circuit at the time of insertion, which has for an effect to considerably limit the number of connection/disconnection manipulations.

A second problem is to assure a sufficient contact pressure between the contacts of the accessory and the connection areas of the printed circuit.

The object of the invention is precisely to resolve the above two problems.

SUMMARY OF THE INVENTION

According to the invention, the connector is characterized in that it comprises a base without contacts, designed to be attached onto the edge of the printed circuit board, this base having an opening to receive a plug having two parallel rows of elastic contacts designed to be supported on said conductive areas, after insertion of the plug into the opening of the base, one of the rows of contacts being borne by a first flexible part of the plug that can engage in the opening of the base, the other row of contacts being borne by a second part of the plug separated from the first part by a recess and that can be engaged under the edge of the printed circuit board, inside the base, and the plug having means that cooperate during the insertion of the plug into the base in order to:

- guide the introduction of the plug into the base, without the row of contacts touching the edges of the board and the connection areas;
- move the plug upward to permit a lining up of the row of contacts borne by the second part of the plug on the conductive areas situated below the edge of the board and simultaneously;
- bend the first flexible part of the plug downward, to permit a lining up of the row of contacts borne by this flexible part onto the conductive areas situated on the edge of the board.

Thus, the contacts of the plug do not rub against the outer edges of the board during the engagement of the plug into the base. Moreover, the friction on the connection areas is very limited.

In fact, the contacts are supported elastically on the connection areas of this board only when the socket is almost completely engaged in the edge of the board, without degradation of the contacts upon the insertion of the plug into the base.

Thus one considerably limits the wear of the connection areas of the board.

Moreover, there is a self-cleaning of the contacts after the first insertion phase when these latter rub against the areas of the printed circuit over a short distance for complete engagement.

According to one preferred version of the invention, the base and the plug have complementary means for locking them together at the end of the course of introduction of the plug into the base.

Also preferably, the means for moving the plug upward comprise ascending ramps situated inside the base and projecting above a plane passing through the lower edge of the introduction opening of the plug, these ramps cooperating with the end of the plug to move it upward.

Also preferably, the means for bending the flexible part of the plug downward comprise at least one descending ramp situated inside the base and projecting below a plane passing through the upper edge of the introduction opening of the plug, this ramp cooperating with the end of said flexible part to make it bend downward.

Other particular points and advantages of the invention will appear again in the description below.

In the attached drawings, given by way of non-limiting examples:

DETAILED DESCRIPTION OF THE INVENTION

Figure 1:
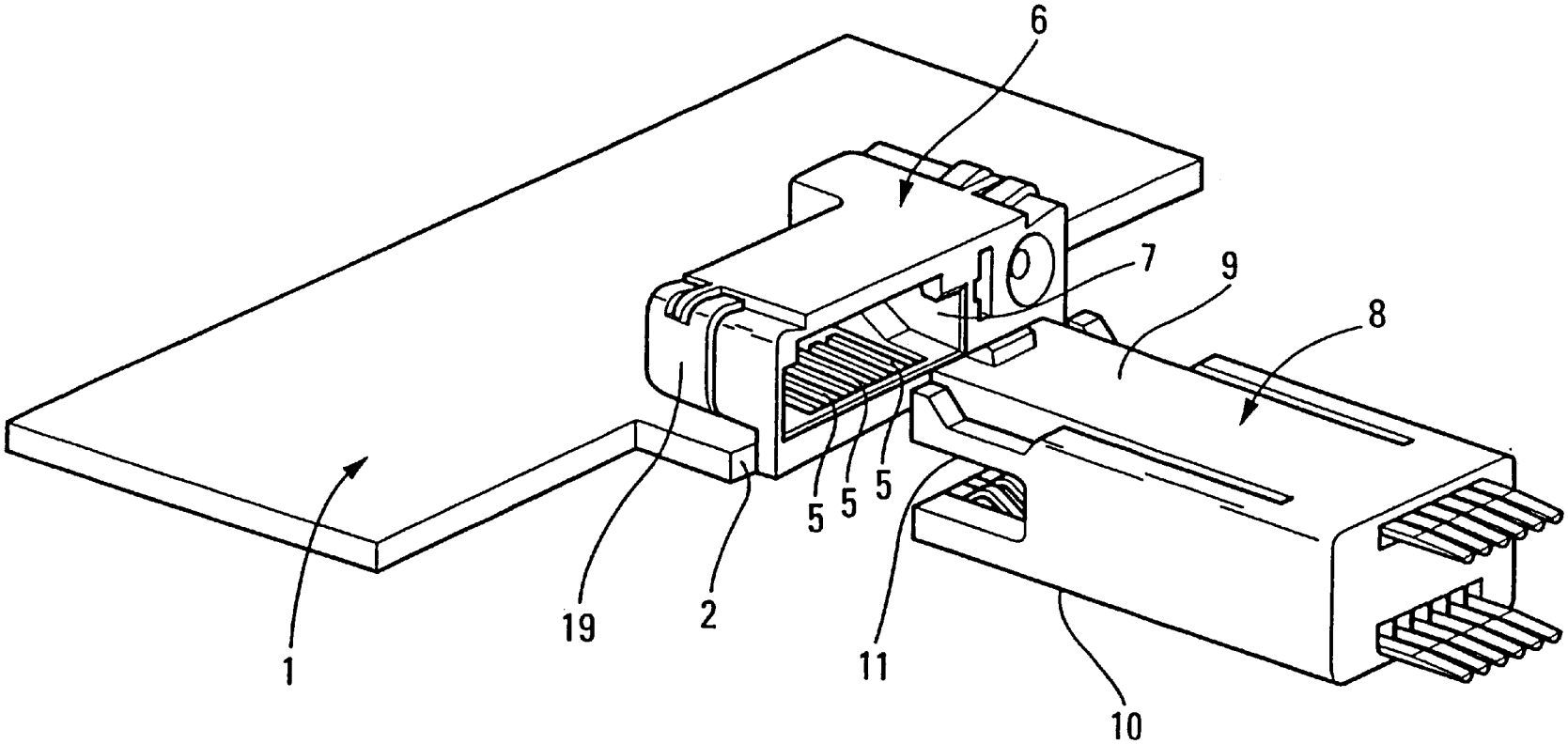
FIG. 1 is a perspective view of the base attached onto a printed circuit board and the plug of a connector conforming to the invention.

In the embodiment shown in FIGS. 1 to 4, the connector designed to come to be engaged on edge 2 of a printed circuit board 1, has contacts 3, 4 designed to be supported elastically on either side of board 1 to establish a direct connection with conductive connection areas 5 of this board.

Conforming to the invention, the connector comprises a base 6 free of contacts designed to be attached onto printed circuit board 1 by anchoring tabs 19 (fittings). This base 6 has an opening 7 to receive a plug 8 comprising two parallel rows of elastic contacts 3, 4 designed to be supported on conductive areas 5, after insertion of plug 8 into opening 7 of base 6.

Figure 2:
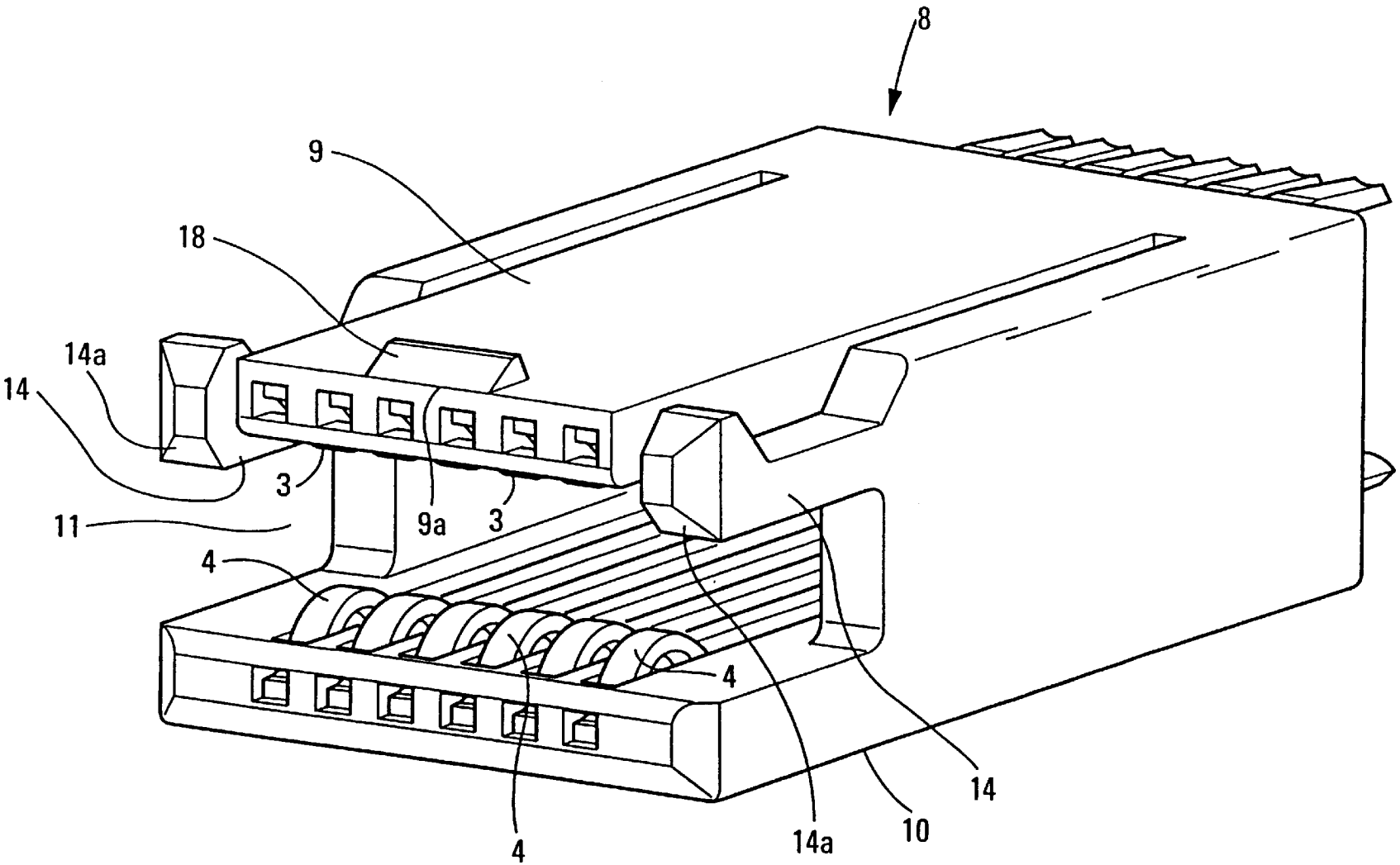
FIG. 2 is a perspective view in enlarged scale of the plug.
Figure 3:
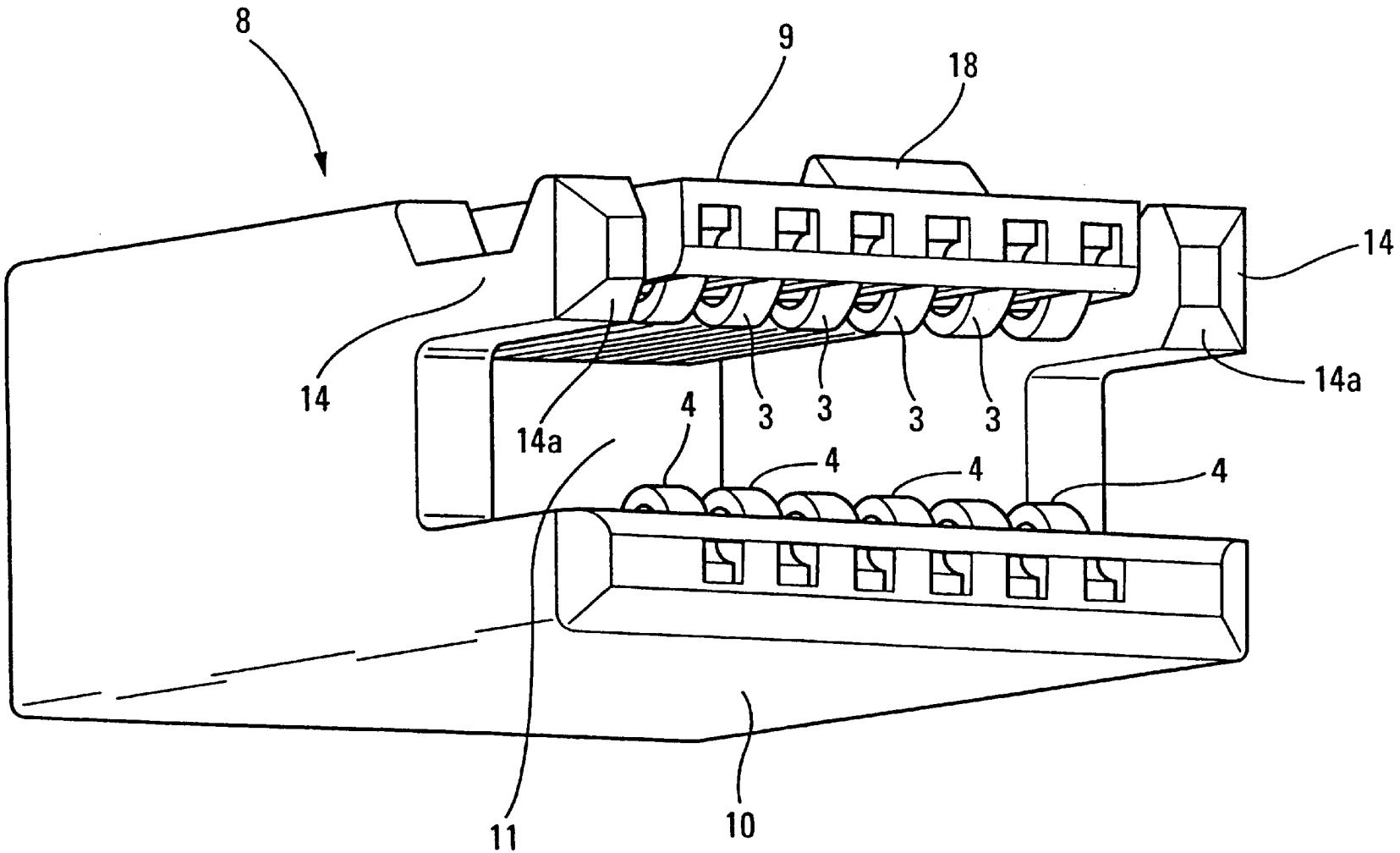
FIG. 3 is another perspective view of the plug.

As indicated in FIGS. 2 and 3, one row 3 of contacts is borne by a first flexible part 9 of plug 8 that can be engaged in opening 7 of base 6. The other row of contacts 4 is borne by a second part 10 of plug 8 separated from the first part 9 by a recess 11 and that can be engaged under edge 2 of printed circuit board 1.

The inside of base 6 and plug 8 has means that cooperate during the insertion of plug 8 into base 6 in order to:

- guide the introduction of plug 8 into base 6 without contact rows 3,4 touching connection areas 5 of board 1;
- move plug 8 upward to permit a lining up of the row of contacts 4 borne by the second part 10 of plug 8 on conductive areas 5 situated under edge 2 of board 1 and simultaneously;
- bend first flexible part 9 of plug 8 downward to permit a lining up of contact row 3 borne by this flexible part 9 on conductive areas 5 situated on edge 2 of board 1.

Moreover, base 6 and plug 8 have complementary means to lock them together at the end of the course of introduction of plug 8 into base 6.

Figure 4:
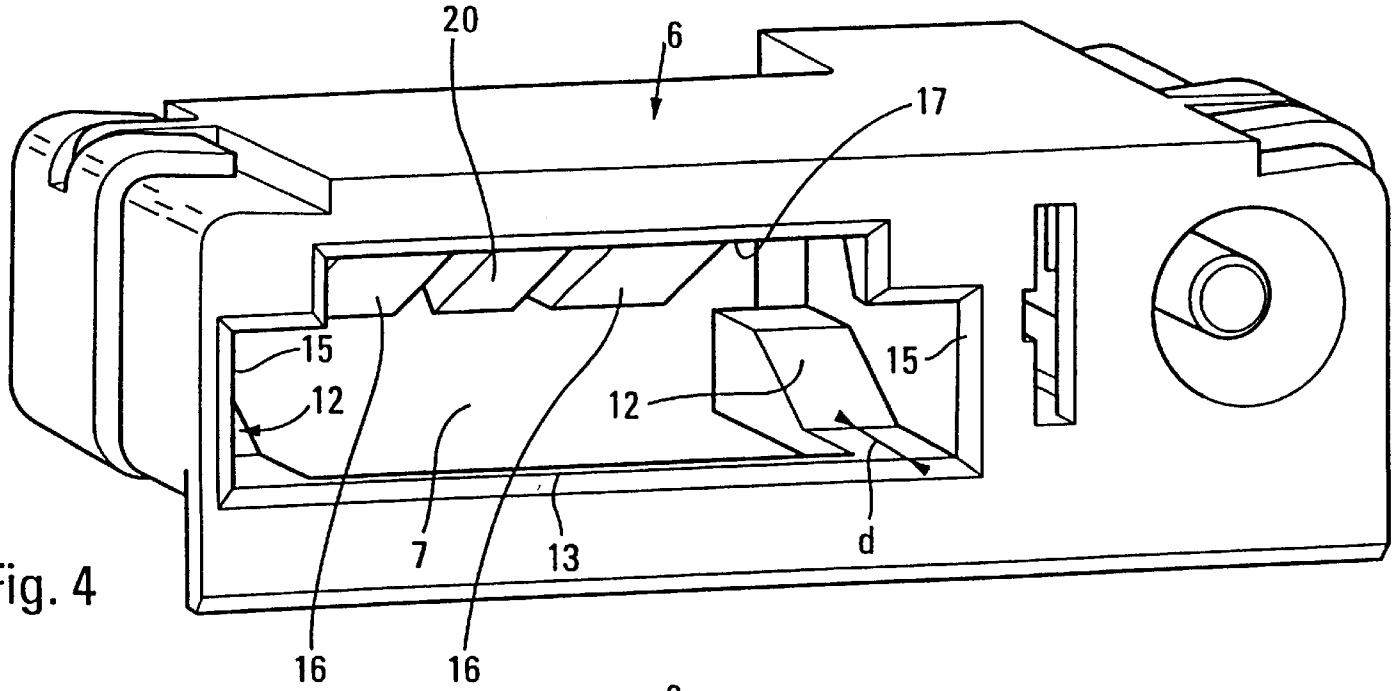
FIG. 4 is another perspective view of the base.
Figure 5:
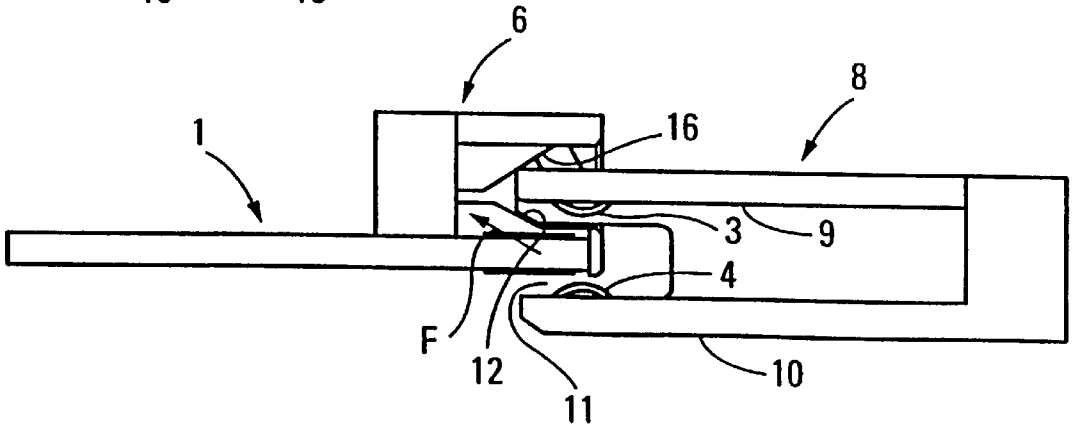
FIG. 5 is a longitudinal sectional view of the plug partially engaged in the base.

As shown by FIGS. 4 and 5, the means for moving plug 8 upward during its insertion into base 6 comprise two ascending ramps 12 situated inside base 6 and projecting above a plane passing through the lower edge 13 of opening 7 for introduction of plug 8 into base 6. These ramps 12 cooperate with end 14*a* of two guiding posts 14 arranged on either side of flexible part 9 of plug 8 to move it toward the top.

FIG. 4 shows, on the other hand, that ramps 12 are situated at a certain distance d from lower edge 13 of opening 7 for introduction of plug 8 into base 6.

The two ramps 12 are each situated close to a lateral edge 15 of opening 7 for introduction of plug 8.

The means for bending flexible part 9 of plug 8 downward during its insertion into base 6 comprise two descending ramps 16 (see FIG. 4) situated inside base 6 and projecting below a plane passing through upper edge 17 of opening 7 for introduction of plug 8. These ramps 16 cooperate with end 9*a* of flexible part 9 of the plug to make it bend downward.

Complementary means for locking together base 6 and plug 8 comprise a ratcheting catch 18 (see FIGS. 2 and 3) arranged on the upper face and close to end 9*a* of flexible part 9 of plug 8 cooperating with a flexible strip 20 (see FIG. 4) arranged in base 6.

The connector that has just been described functions in the following manner:

During the introduction of plug 8 into opening 7 of base 6, ends 14*a* of guiding posts 14 of plug 8 slide over ramps 12, which imparts an ascending movement to plug 8 (see arrow F in FIG. 5).

This ascending movement moves lower part 10 of plug 8 close to the lower face of board 1.

At the end of the course, lower row 4 of contacts takes support elastically on connection areas 5 provided on the lower face of the board.

Simultaneously, end 9*a* of flexible part 9 of plug 8 slides over upper ramps 16 of base 6, which bends flexible part 9 downward. This bending downward brings upper row 3 of contacts into contact with conductive areas 5 provided on the upper face of board 1.

Contacts 3 and 4 slide along a short course over conductive areas 5 of the board, which generates a beneficial effect of self-cleaning.

At the end of the course, catch 18 situated in front of flexible part 9 of plug 8 comes to be ratcheted onto the end of strip 20 situated inside base 6, thus locking plug 8 of base 6.

Of course, the invention is not limited to the example that has just been described and one can introduce numerous modifications to the latter without exceeding the scope of the invention.

What is claimed is:

1. Connector designed to come to be engaged on edge (2) of a printed circuit board (1) and having contacts (3, 4) designed to take support elastically on either side of board (1) to establish a direct connection with conductive areas (5) of this board, comprising: a socket which comprises a base (6) without contacts, designed to be attached onto printed circuit board (1) by anchoring tabs (19), this base (6) comprising an opening (7) to receive a plug (8) having two parallel rows of elastic contacts (3, 4), designed to take support on said conductive areas (5), after insertion of plug (8) into opening (7) of base (6), one of the rows of contacts (3) being borne by a first flexible part (9) of plug (8) that can be engaged in opening (7) of base (6), the other row of contacts (4) being borne by a second part (10) of the plug separated from first part (9) by a recess (11) and that can be engaged under edge (2) of printed circuit board (1) inside base (6), and plug (8) having means that cooperate during insertion of plug (8) into base (6) in order to:

guide introduction of plug (8) into base (6) without contact rows (3, 4) touching connection areas (5) of the board;

move plug (8) upward to permit a lining up of the row of contacts (4) borne by the second part (10) of the plug (8) onto conductive areas (5) situated under edge (2) of the board and simultaneously;

bend first flexible part (9) of plug (8) downward to permit a lining up of row of contacts (3) borne by this flexible part (9) on conductive areas (5) situated on edge (2) of the board.

2. Connector as in claim 1, further wherein ramps (12) are situated at a certain distance from a lower edge (13) of opening (7) for introduction of plug (8) into base (6).

3. Connector as in claim 1, wherein the base (6) and plug (8) have complementary means for locking them together at an end of a course of introduction of plug (8) into base (6).

4. Connector as in claim 3, wherein complementary means for locking together base (6) and plug (8) comprise a ratcheting catch (18) arranged on an upper face and close to the end (9*a*) of flexible part (9) of plug (8) cooperating with a flexible strip (20) arranged in base (6).

5. Connector designed to come to be engaged on edge (2) of a printed circuit board (1) and having contacts (3, 4) designed to take support elastically on either side of board (1) to establish a direct connection with conductive areas (5) of this board, comprising: a socket which comprises a base (6) without contacts, designed to be attached onto printed circuit board (1) by anchoring tabs (19), this base (6) comprising an opening (7) to receive a plus (8) having two parallel rows of elastic contacts (3, 4), designed to take support on said conductive areas (5), after insertion of plug (8) into opening (7) of base (6), one of the rows of contacts (3) being borne by a first flexible part (9) of plug (8) that can be engaged in opening (7) of base (6), the other row of contacts (4) being borne by a second part (10) of the plug separated from first part (9) by a recess (11) and that can be engaged under edge (2) of printed circuit board (1) inside base (6), and plug (8) having means that cooperate during insertion of plug (8) into base (6) in order to:

guide introduction of plug (8) into base (6) without contact rows (3, 4) touching connection areas (5) of the board;

move plug (8) upward to permit a lining up of the row of contacts (4) borne by the second part (10) of the plug (8) onto conductive areas (5) situated under edge (2) of the board and simultaneously;

bend first flexible part (9) of plug (8) downward to permit a lining up of row of contacts (3) borne by this flexible part (9) on conductive areas (5) situated on edge (2) of the board, and the means for moving plug (8) upward comprising ascending ramps (12) situated inside base (6) and projecting above a plane passing through lower edge (13) of introduction opening (7) of plug (8), these ramps (12) cooperating with end (14*a*) of the plug to move it upward.

6. Connector as in claim 5, wherein said ramps (12) are two in number and are each situated close to a lateral edge of opening (7) for introduction of plug (8).

7. Connector designed to come to be engaged on edge (2) of a printed circuit board (1) and having contacts (3, 4) designed to take support elastically on either side of board (1) to establish a direct connection with conductive areas (5) of this board, comprising: a socket which comprises a base (6) without contacts, designed to be attached onto printed circuit board (1) by anchoring tabs (19), this base (6) comprising an opening (7) to receive a plug (8) having two parallel rows of elastic contacts (3, 4), designed to take support on said conductive areas (5), after insertion of plug (8) into opening (7) of base (6), one of the rows of contacts (3) being borne by a first flexible part (9) of plug (8) that can be engaged in opening (7) of base (6), the other row of contacts (4) being borne by a second part (10) of the plug separated from first part (9) by a recess (11) and that can be engaged under edge (2) of printed circuit board (1) inside base (6), and plug (8) having means that cooperate during insertion of plug (8) into base (6) in order to:

guide introduction of plug (8) into base (6) without contact rows (3, 4) touching connection areas (5) of the board;

move plug (8) upward to permit a lining up of the row of contacts (4) borne by the second part (10) of the plug (8) onto conductive areas (5) situated under edge (2) of the board and simultaneously;

bend first flexible part (9) of plug (8) downward to permit a lining up of row of contacts (3) borne by this flexible part (9) on conductive areas (5) situated on edge (2) of the board, and the means for bending flexible part (9) of plug (8) downward comprising at least one descending ramp (16) situated inside base (6) and projecting below a plane passing through an upper edge (17) of opening (7) for introduction of plug (8), this ramp (16) cooperating with end (9*a*) of said flexible part (9) to make it bend downward.

8. Connector designed to come to be engaged on edge (2) of a printed circuit board (1) and having contacts (3, 4) designed to take support elastically on either side of board (1) to establish a direct connection with conductive areas (5) of this board, comprising: a socket which comprises a base (6) without contacts, designed to be attached onto printed circuit board (1) by anchoring tabs (19), this base (6) comprising an opening (7) to receive a plug (8) having two parallel rows of elastic contacts (3, 4), designed to take support on said conductive areas (5), after insertion of plus (8) into opening (7) of base (6), one of the rows of contacts (3) being borne by a first flexible part (9) of plug (8) that can be engaged in opening (7) of base (6), the other row of contacts (4) being borne by a second part (10) of the plug separated from first part (9) by a recess (11) and that can be engaged under edge (2) of printed circuit board (1) inside base (6), and plug (8) having means that cooperate during insertion of plug (8) into base (6) in order to:

guide introduction of plug (8) into base (6) without contact rows (3, 4) touching connection areas (5) of the board;

move plug (8) upward to permit a lining up of the row of contacts (4) borne by the second part (10) of the plug (8) onto conductive areas (5) situated under edge (2) of the board and simultaneously;

bend first flexible part (9) of plug (8) downward to permit a lining up of row of contacts (3) borne by this flexible part (9) on conductive areas (5) situated on edge (2) of the board, and wherein the flexible part (9) of plug (8) is arranged between two lateral guiding posts (14) of this plug (8).

* * * * *